US011236521B2

(12) United States Patent
Hequily

(10) Patent No.: US 11,236,521 B2
(45) Date of Patent: Feb. 1, 2022

(54) DYNAMIC ARTIFICIAL WAVE FACILITY FOR SURFING PRACTICE

(71) Applicant: Laurent Hequily, La Teste de Buch (FR)

(72) Inventor: Laurent Hequily, La Teste de Buch (FR)

( * ) Notice: Subject to any disclaimer, the term of this patent is extended or adjusted under 35 U.S.C. 154(b) by 0 days.

(21) Appl. No.: 17/264,639

(22) PCT Filed: Jul. 29, 2019

(86) PCT No.: PCT/FR2019/051863
§ 371 (c)(1),
(2) Date: Jan. 29, 2021

(87) PCT Pub. No.: WO2020/025887
PCT Pub. Date: Feb. 6, 2020

(65) Prior Publication Data

US 2021/0324647 A1 Oct. 21, 2021

(30) Foreign Application Priority Data

Jul. 30, 2018 (FR) ..... 1857113

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01); *A63B 2225/60* (2013.01)

(58) Field of Classification Search
CPC ..... E04H 4/0006; A63B 69/0093; A47K 3/10
(Continued)

(56) References Cited

U.S. PATENT DOCUMENTS 1,811,565 A * 6/1931 Schwabacher ..... F03B 13/183 415/60
3,913,332 A 10/1975 Forsman
(Continued)

FOREIGN PATENT DOCUMENTS

EP 0293831 A1 * 12/1988
FR 3 039 421 2/2017
(Continued)

OTHER PUBLICATIONS

International Search Report for PCT/FR2019/051863 dated Nov. 12, 2019, 5 pages.
(Continued)

*Primary Examiner* — Sunil Singh
(74) *Attorney, Agent, or Firm* — Nixon & Vanderhye

(57) ABSTRACT

Disclosed is a facility including an artificial wave generator having an element for driving moving water along a predetermined path, including a first body profiled as a hydrofoil, orientated upright, having a leading edge towards the front, a trailing edge towards the rear, first and second main faces extending respectively on a first side and a second side, between the leading and trailing edges, and being configured with respect to the path so that when the generator is in service, a lift force directed towards a wave development zone is applied on the first body; and a second body profiled as a hydrofoil, orientated horizontally, having a leading edge towards the front, a trailing edge towards the rear, first and second main faces extending respectively on a first side and a second side.

20 Claims, 9 Drawing Sheets

(58) Field of Classification Search
USPC ..... 405/79; 4/491
See application file for complete search history.

(56) References Cited

U.S. PATENT DOCUMENTS

| | | | | |
|---|---|---|---|---|
| 6,019,547 | A * | 2/2000 | Hill | A63G 31/007 4/491 |
| 2003/0119592 | A1 | 6/2003 | Lochtefeld et al. | |
| 2009/0185863 | A1 * | 7/2009 | McFarland | A63G 31/007 405/79 |
| 2013/0074254 | A1 * | 3/2013 | Payne | E04H 4/0006 4/491 |
| 2014/0115769 | A1 * | 5/2014 | Murphy | A63B 69/0093 4/491 |
| 2018/0363312 | A1 * | 12/2018 | Trevis | A63B 69/00 |

FOREIGN PATENT DOCUMENTS

| | | | |
|---|---|---|---|
| JP | 52-4632 | A * | 1/1977 |
| WO | WO 2013071362 | A1 * | 5/2013 |
| WO | 2013/078502 | | 6/2013 |
| WO | WO 2014190314 | A2 * | 11/2014 |
| WO | WO 2015173477 | A1 * | 11/2015 |
| WO | 2017/017319 | | 2/2017 |

OTHER PUBLICATIONS

Written Opinion of the ISA for PCT/FR2019/051863 dated Nov. 12, 2019, 5 pages.

* cited by examiner

DYNAMIC ARTIFICIAL WAVE FACILITY FOR SURFING PRACTICE

CROSS-REFERENCE TO RELATED APPLICATIONS

This application is the U.S. national phase of International Application No. PCT/FR2019/051863 filed Jul. 29, 2019 which designated the U.S. and claims priority to FR 1857113 filed Jul. 30, 2018, the entire contents of each of which are hereby incorporated by reference.

FIELD OF THE INVENTION

The invention relates to dynamic artificial wave facilities for the practice of surfing.

TECHNOLOGICAL BACKGROUND

It is known that dynamic artificial waves reproduce natural waves that propagate and must not be confused with static artificial waves which are formed by a layer of water of uniform thickness, for example of the order of 10 cm, projected onto a sloping wall.

In the present document, it is intended that the references to artificial waves be understood as being directed to dynamic artificial waves and not static artificial waves.

There is already known, by French patent application 3 039 421, to which corresponds international application WO 2017/017319, an artificial wave facility for the practice of surfing, comprising:

- a support having an upper surface comprising an edge zone, a wave progression zone and a culminating zone, the wave progression zone extending, in an upwards slope, from the edge zone to the culminating zone;
- water situated over said edge zone and said wave progression zone; and
- an artificial wave generator comprising at least one water driving member movable over the edge zone along a predetermined path, said wave generator and said upper surface of the support being configured such that when the wave generator is in use, the movable member is laterally followed by a wave moving in the water towards the wave progression zone in contact with which the generated wave breaks towards the culminating zone.

Example embodiments of this facility are described below with the aid of FIGS. 1 to 6 of the accompanying drawings, in which:

FIG. 1 is a view from above of a first embodiment of this facility of which the artificial wave generator is at rest;

FIGS. 2 and 3 are cross section views respectively on II-II and III-III in FIG. 1;

FIG. 4 is a view similar to FIG. 1 but with the artificial wave generator in use;

FIG. 5 is the cross-section view on V-V of FIG. 4; and

FIG. 6 is a similar view to FIG. 2 for a second example embodiment of this facility.

The facility 10 illustrated in FIGS. 1 to 5 comprises a floating platform 11, here with a circular outer contour and an artificial wave generator 12 installed on the platform 11.

The platform 11 has an upper surface 14 comprising an edge zone 15, a wave progression zone 16 and a culminating zone 17.

The artificial wave generator 12 comprises four water drive members 20, each movable along a predetermined path 21, which is circular here.

Each mobile member 20 moves over the edge zone 15.

The facility 10 is situated in a body of calm water, with no or very little disturbance such as natural waves. The shore of the body of water is at a distance from the facility 10, which thus forms an island.

When the wave generator 12 is at rest, that is to say when the movable members 20 are fixed, the culminating zone 17 is emerged.

In FIGS. 1 and 4, the limit between the zones that are emerged and immersed when the wave generator is at rest, is represented by a line 18 of mixed dashes.

When the wave generator 12 is in use, each mobile member 20 is laterally followed, as can be seen in FIG. 4, by a wave 22 moving towards the wave progression zone 16, in contact with which the wave 22 generated breaks towards the culminating zone 17.

The platform 11 for example has a diameter of 60 to 80 m or even more and the waves 22 have a height of the order of 2 m for the practice of traditional surfing (surfer standing on a board); while for the practice of surfing lying on an appropriate board (bodyboard), the facility for example has a diameter of 18 to 22 m or more and the waves 22 have a height of the order of 50 to 60 cm.

Here, the body of water is formed by a sheltered maritime bay or cove.

As a variant, the maritime bay or cove is replaced by another body of water in a natural environment, for example a lake or a river if there is not too much current, or in an artificial setting, for example a pond of masonry.

The aquatic environment 23 (here, the sea) with which cooperate the platform 11 and the wave generator 12 comprises a region 24, called inner aquatic region, situated over the edge zone 15 and the wave progression zone 16.

In addition to the inner aquatic region 24, the aquatic environment 23 comprises, outside the platform 11 along the edge zone 15, a region 25, called upper outer aquatic region, situated higher than the edge zone 15 and a region 26, called deep outer aquatic region, situated lower than the edge zone 15.

The aquatic environment 23 lastly comprises, below the platform 11, a region 27, called underlying aquatic region.

The deep outer aquatic region 26 and the upper outer aquatic region 25 are horizontally contiguous.

The inner aquatic region 24 and the upper outer aquatic region 25 are vertically contiguous.

Similarly, the underlying aquatic region 27 and the deep outer aquatic region 26 are vertically contiguous.

It is to be clearly understood that the subdivision of the aquatic environment 23 into aquatic regions 24 to 27 is solely based on the location of the regions in question relative to the platform 11, that is to say that the regions 24 to 27 designate locations at which water is to be found and not isolated volumes of water.

It will be noted in this connection that there are no liquid-tight walls isolating the different aquatic regions 24 to 27 from each other.

On the contrary, the water of the aquatic environment 23 (here sea water) flows between the different aquatic regions 24 to 27.

Thus, when the wave generator 12 is at rest, the entire aquatic environment 23 has the same surface level.

In particular, as can be clearly seen in FIGS. 1 to 3, the surface level of the inner aquatic region 24 is identical to the surface level of the upper outer aquatic region 25.

To protect the surfers against possible marine predators, a grid or net 28 may be provided (shown diagrammatically only on FIGS. 2, 3 and 5) between the inner aquatic region 24 and the upper outer aquatic region 25. Similarly, a grid or a net (not shown) may be provided around the path 21 to avoid any contact between the movable members 20 and the surfers.

The upper surface 14 of the platform 11 comprises, in addition to the edge zone 15, the wave progression zone 16 and the culminating zone 17, a crest 30 and a depressed zone 31 depressed relative to the crest 30.

The crest 30 is located between the culminating zone 17 and the depressed zone 31. More specifically, the crest 30 is located between the apex of the culminating zone 17 and the apex of the depressed zone 31.

As can be clearly seen in FIGS. 4 and 5, the culminating zone 17 and the depressed zone 31 are configured such that when the wave generator 12 is in use, the water at the end of travel of the waves 22 gets past the crest 30 and falls into a volume 32 delimited by the depressed zone 31, this volume being called reception volume.

Openings 33 or 39 formed through the platform 11 respectively open into the reception volume 32 and into the underlying aquatic region 27.

The underlying aquatic region 27 provides fluidic communication linking the deep outer aquatic region 26 to the openings 33 or 39, and thus to the reception volume 32.

As can be clearly seen in FIGS. 2 and 3, this results in the surface level of the reception volume 32 remaining the same for the whole of the aquatic environment 23 when the wave generator 12 is at rest or, as can be clearly seen in FIG. 5, the same only for the aquatic environment 23 outside the inner aquatic region 24 when the wave generator 12 is in use.

Thus, when the wave generator 12 is in use, the water at the end of travel of the waves 22 leaves the inner aquatic region 24 by falling into the reception volume 32 from which it is evacuated without passing by the inner aquatic region 24 since the fluidic communication is situated under the platform 11.

The upper outer aquatic region 25 is not disturbed either, or is disturbed very little, since it is the deep outer aquatic region 26 which is in communication with the reception volume 32.

As the inner aquatic region 24, and furthermore the upper outer aquatic region 25, are not therefore disturbed by the backwash, or whatever the case are very little disturbed, it is possible to have a very short time between two successive waves 22.

What is more, the platform 11 is acted on mechanically relatively little by the waves 22 since the water is guided towards the reception volume 32 from which it naturally goes to join the underlying aquatic region 27 which communicates with the deep outer aquatic region 26.

An explanation will now be given of how the platform 11, which is a floating platform as indicated above, is held in place in the aquatic environment 23.

In general terms, the capacity to float of the platform 11 is provided in order for the edge zone 15 to be at a predetermined distance under the surface level of the aquatic environment 23.

This predetermined distance is that which is appropriate for the proper operation of the wave generator 12.

To hold the platform 11 in relation to the bottom 35 of the aquatic environment 23, links 36 such as chains are provided between the platform 11 and moorings 37 placed on the bottom 35.

A pile 38 is also provided which is fastened to the bottom 35 and engaged in a central opening 39 of the platform 11.

When changes in surface level of the platform occur due to the tide, the platform 11 slides relative to the pile 38 and the links 36 retain the platform 11, in particular to avoid it turning around the pile 38.

As a variant, the platform 11 is held differently in relation to the bottom 35, for example solely with links such as 36 or solely with piles such as 38.

Here, the platform 11 is manufactured from composite materials in the manner of the hull wall of a boat.

As a variant, the composite materials are replaced by other materials used for the manufacture of boat hulls, for example aluminum or wood.

To adjust the capacity to float of the platform 11, chambers (not shown) may be provided, which can be filled to a greater or lesser extent with water.

In normal use, the chambers are filled to adjust the capacity to float as has just been indicated, that is to say in order for the edge zone 15 to be at the desired predetermined distance below the surface level of the aquatic environment.

If it is desired for the platform 11 to emerge more, for example for maintenance operations, the chambers are emptied.

If it is desired for the platform 11 to sink down further, for example to rest on the bottom 35 in case of a storm, the tanks are filled.

As a variant, the platform 11 is not a floating platform but is for example supported by pylons fastened to the bottom 35.

In addition to the platform 11 and the wave generator 12, the facility 10 comprises a groin 40 connected to the platform 11.

The groin 40 projects upwards from the wave progression zone 16 while extending through the inner aquatic region 24 from the culminating zone 17 towards the edge zone 15.

The groin 40 has an upper surface 41 comprising a first lateral zone 42, a second lateral zone 43 situated on the opposite side to the first lateral zone 42 and an intermediate zone 44 extending from the first lateral zone 42 to the second lateral zone 43.

Here, the intermediate zone 44 comprises a first crest 45 and a second crest 46, each being emerged when the wave generator 12 is at rest.

The intermediate zone 44 also comprises a depressed zone 47 which is depressed relative to the first crest 45 and the second crest 46, the first crest 45 being located between the first lateral zone 42 and the depressed zone 47, the second crest 46 being located between the second lateral zone 43 and the depressed zone 47.

More specifically, the first crest 45 is located between the apex of the first lateral zone 42 and one of the two apexes of the depressed zone 47; and the second crest 46 is located between the apex of the second lateral zone 43 and the other apex the depressed zone 47.

The first crest 45, the second crest 46 and the depressed zone 47 are configured such that when the wave generator 12 is in use, the water at the end of travel of the waves 22 gets past the first crest 45 or the second crest 46 and falls into a volume 48 delimited by the depressed zone 47, hereinafter called reception volume.

Here, the reception volume 48 of the groin 40 and the reception volume 32 of the platform 11 are vertically contiguous.

More specifically here, as can be clearly seen in FIGS. 1 to 3, the depressed zone 47 which delimits the reception volume 48 has a U-shaped profile and the depressed zone 31 which delimits the reception volume 32 is of frusto-conical general shape with an interruption at the groin 40. The depressed zones 31 and 47 are connected at the location of the interruption.

The crest 30 of the platform 11 is connected at one end to the first crest 45 of the groin 40 and connects at the other end to the second crest 46 of the groin 40.

On the opposite side to that at which it connects to the reception volume 32, the reception volume 48 is open here at the location of the junction between the wave progression zone 16 and the edge zone 15.

The reception volume 48 is thus in fluidic communication with the upper outer aquatic region 25 via the part of the inner aquatic region 24 which is situated over the edge zone 15.

Openings 49, similar to the openings 33, are formed through the lowest part of the wall which forms the depressed zone 47. The openings 49 respectively open into the reception volume 48 and into the underlying aquatic region 27.

The reception volume 48 is thus in fluidic communication, via the underlying aquatic region 27, with the deep outer aquatic region 26.

The water at the end of travel of the waves that has fallen into the reception volume 48 is thus evacuated towards the deep outer aquatic region 26 and/or the upper outer aquatic region 25.

The reception volume 48, on account of the fact that it joins the reception volume 32, is able to participate in the evacuation of the water that has fallen into the reception volume 32.

The connection between the platform 11 and the groin 40 is created here due to the platform 11 and the groin 40 being a single part, the platform 11 and the groin 40 being manufactured conjointly from composite materials in the manner of a boat hull wall.

As a variant, the composite materials are replaced by other materials used for the manufacture of boat hulls, for example aluminum or wood.

As a variant, the groin 40 is a part added onto the platform 11.

The wave generator 12 comprises, as indicated above, four water drive members 20, each movable along the predetermined path 21, which is circular here.

Each movable member 20 moves over the edge zone 15, in the direction shown by arrows in FIG. 4, while driving water towards the wave progression zone 16.

More specifically, each movable member 20 is laterally followed by a wave 22 moving towards the wave progression zone 16. On contact with the wave progression zone 16, the wave 22 breaks towards the culminating zone 17.

The movable members 20 are disposed on the path 21 while being angularly equidistant.

The artificial wave generator 12 it of a well-known type, for example such as that described by U.S. Pat. No. 3,913,332.

It will be noted that it is possible to shape the movable members 20 in order for them also to generate waves by moving in the opposite direction to that illustrated in FIG. 4.

The facility 10 thus gives surfers the possibility of traveling on waves breaking towards the right or on waves breaking towards the left, according to the direction of movement of the movable members 20.

The upper surface 14 of the platform 11 here comprises, between the edge zone 15, which is horizontal, and the wave progression zone 16, which is inclined, a shoulder zone 50 which is vertical or substantially vertical.

The shoulder zone 50 creates an obstacle to the propagation of the water which has been made to move by the movable member 20, which promotes the quality, for the practice of surfing, of the wave generated before it breaks on the wave progression zone 16.

The groin 40, which is disposed across the inner aquatic region 24, enables a possible current of water turning around the culminating zone 17 to be interrupted.

It will be noted in particular that the waves 22 are stopped by the groin 40; and that after the mobile member 20 has got past the groin 40 a new wave 22 begins in calm water or in any event water which has not been disturbed by the previous wave 22.

The presence of the upper outer aquatic region 25 also promotes the limitation of currents in the inner aquatic region 24.

As a variant, the groin is employed in a facility in which there is no outer aquatic region.

To avoid backwash as much as possible, the first lateral zone 42 of the groin 40, which is that acted upon most by the waves 22 since the movable members 20 turn in the direction in which they approach that lateral zone, is provided with spits 51.

As explained above, the groin 40 also serves for the evacuation of the water at the end of travel of the waves.

To avoid the movable members 20 causing water to enter the reception volume 48, appropriate measures are employed, for example a shutter which closes the opening towards the outside of the reception volume 48 when the movable member 20 passes in front, or the path 21 is configured in order for the movable members 20 to pass over the surface of the water at that location.

As a variant, the groin 40 does not comprise any reception volume 48, for example by having the intermediate zone 44 of its upper surface 41 replaced by a simple crest.

In another variant not shown, the facility 10 does not comprise a groin such as the groin 40.

A description will now be given of FIG. 6, with reference to the facility 10.

For convenience, for similar parts, the same numerical references have been kept as for the facility 10 illustrated in FIGS. 1 to 5.

In general terms, the facility 10 illustrated in FIG. 6 is similar to the facility 10 illustrated in FIGS. 1 to 5, apart from the fact that the support which provides the upper surface 14 is not a platform situated over an underlying aquatic region but a substrate 55 forming part of the ground and surrounded by an annular pond 56 of which the bottom surface 54 is much lower than the edge zone 15; and the fact that the water of the aquatic environment 23 is treated water, in this case swimming-pool water.

To implement the fluidic communication situated under the upper surface 14 of the support formed by the substrate 55, pipes 57 are formed in the substrate 55. Each pipe 57 opens at one end, by an opening 58, into the reception volume 32 of the substrate 55 and, at the other end, by an opening 59, into the deep aquatic region 26.

Here, the substrate 55 and the annular pond 56 are formed by a structure of masonry.

In variants that are not represented:

- the number of mobile members such as 20 of the wave generator such as 12 is different from four, for example only one, two, three or more than four;
- an emerged island is provided in the center of the reception volume such as 32 of the support such as the platform 11 or the substrate 55, for example an island on which are disposed buildings;

the path such as 21 of the mobile member or members such as 20, and thus the contour of the support such as the platform 11 or the substrate 55 is annular without being circular, for example oval, oblong and/or with undulations; or for instance this path is not annular, but for example straight or curved.

SUBJECT OF THE INVENTION

The invention is directed to providing an artificial wave facility of the same kind but of which the artificial wave generator provides better performance.

To that end the invention provides an artificial wave facility for the practice of surfing, comprising:

- a support having an upper surface comprising an edge zone, a wave progression zone and a culminating zone, the wave progression zone extending, in an upwards slope, from the edge zone to the culminating zone;
- water situated over said edge zone and said wave progression zone;
- an artificial wave generator comprising at least one water driving member movable over the edge zone along a predetermined path, said wave generator and said upper surface of the support being configured such that when the wave generator is in use, the movable member is laterally followed by a wave moving in the water towards the wave progression zone in contact with which the generated wave breaks towards the culminating zone;

characterized in that said movable member of the wave generator comprises:

- a first body shaped with a cross-section of a lift-generating wing, oriented upright, having a leading edge facing forward, a trailing edge facing rearward, a first main face extending on a first side between the leading edge and the trailing edge, and a second main face extending on a second side, which is an opposite side to the first side, between the leading edge and the trailing edge, the first main face facing towards the wave progression zone, said first body being configured in relation to said predetermined path such that when the wave generator is in use, a lift force directed towards the wave progression zone acts on the first body; and
- a second body shaped with a cross-section of a lift-generating wing, having a lying-down orientation, mechanically connected to the first body, projecting at least partly from the first main face of the first body, having a leading edge facing forward, a trailing edge facing rearward, a first main face extending on a first side between the leading edge and the trailing edge, and a second main face extending on a second side, which is an opposite side to the first side, between the leading edge and the trailing edge, the second main face facing downward, said second body being configured in relation to said predetermined path such that when the wave generator is in use, an upwardly directed lift force acts on the second body.

It will be noted that the concepts of front and rear are used conventionally with reference to the direction of movement provided for the movable member, which goes from the back towards the front.

It is known that when a body shaped with a cross-section of a lift-generating wing is made to move in a fluid under certain conditions, in particular of angle of attack of the relative velocity between that body and the chord plane passing through the leading edge and the trailing edge, the body is subject to a lift force.

Deflection of that fluid occurs transversely to the direction of movement, in the opposite direction to the lift force.

Thus, by advancing in the water along the path of the movable member, which is horizontal, the second body deflects the water downwards.

The water surface thus presents a trough rearward of the second body.

Rearward of that trough, the surface of the water presents a rising front to return to the general level of the water surface.

This rising front forms the front of the wave generated by the movement of the movable member of the wave generator of the facility according to the invention.

On account of the movement of the movable member, the first body, oriented upright, produces effects on the water located rearward of the movable member that tend to deflect it towards the wave progression zone.

Thus, the interaction of the effects of the first body and of the second body causes the wave generated by the movement of the movable member to follow that movable member laterally, rearward of it, moving towards the wave progression zone.

It will be noted that since the water is deflected downwards by the second body to form the trough rearward of the movable member, this deflection of the water must not overcome gravity but on the contrary go with gravity such that only a little energy is sufficient to form that trough, and thus the wave located rearward of that trough.

The movable member can thus be moved in the water with relatively little energy, which is favorable to the performance of the facility according to the invention in terms of energy consumption and impact on the aquatic environment on which the facility according to the invention acts.

What is more, this low energy required to generate the wave makes it possible to control the characteristics thereof more easily, including at relatively low velocity, which is favorable to the quality of the wave generated for the practice of surfing.

It is in particular possible, thanks to the combined effects of the first body and of the second body, to generate a powerful wave, little disturbed by turbulence and correctly oriented in relation to the wave progression zone on which it must break.

According to features that are favorable to the performance of the facility according to the invention:

- the first main face of the second body is an extrados face, the second main face of the second body is an intrados face, the extrados face having a developed length greater than the developed length of the intrados face;
- said first body extends above and below said second body;
- the leading edge of said second body is forward of the leading edge of said first body;
- the trailing edge of said second body is rearward of the leading edge of said first body and forward of the trailing edge of said first body;
- said second body is shaped with a cross-section of a lift-generating wing according to the NACA 9630 airfoil;
- a chord plane passing through the leading edge and through the trailing edge of the second body makes an angle comprised between 6° and 20° relative to the horizontal;
- said movable member further comprises a vane-wall mechanically connected to said first body and second body, said vane-wall being oriented upright and disposed laterally along and at a distance from the first body and second body on the side to which faces the second main face of the first body;

the facility further comprises a fixed lateral wall, oriented upright, which the second main face of the first body faces;

said artificial wave generator further comprises a drive member for driving said movable member, said drive member being fastened to said movable member by the apex of said first body;

the first main face of the first body is an extrados face, the second main face of the first body is an intrados face, the extrados face having a developed length greater than the developed length of the intrados face;

said first body is shaped with a cross-section of a lift-generating wing according to the NACA 9630 airfoil; and/or a chord plane passing through the leading edge and through the trailing edge of the first body makes an angle comprised between 2° and 20° relative to said predetermined path.

BRIEF DESCRIPTION OF THE DRAWINGS

The disclosure of the invention will now be continued with the detailed description of embodiments, given below by way of non-limiting illustration, with reference to the appended drawings. In these.

DETAILED DESCRIPTION OF AN EMBODIMENT

Figure 1:
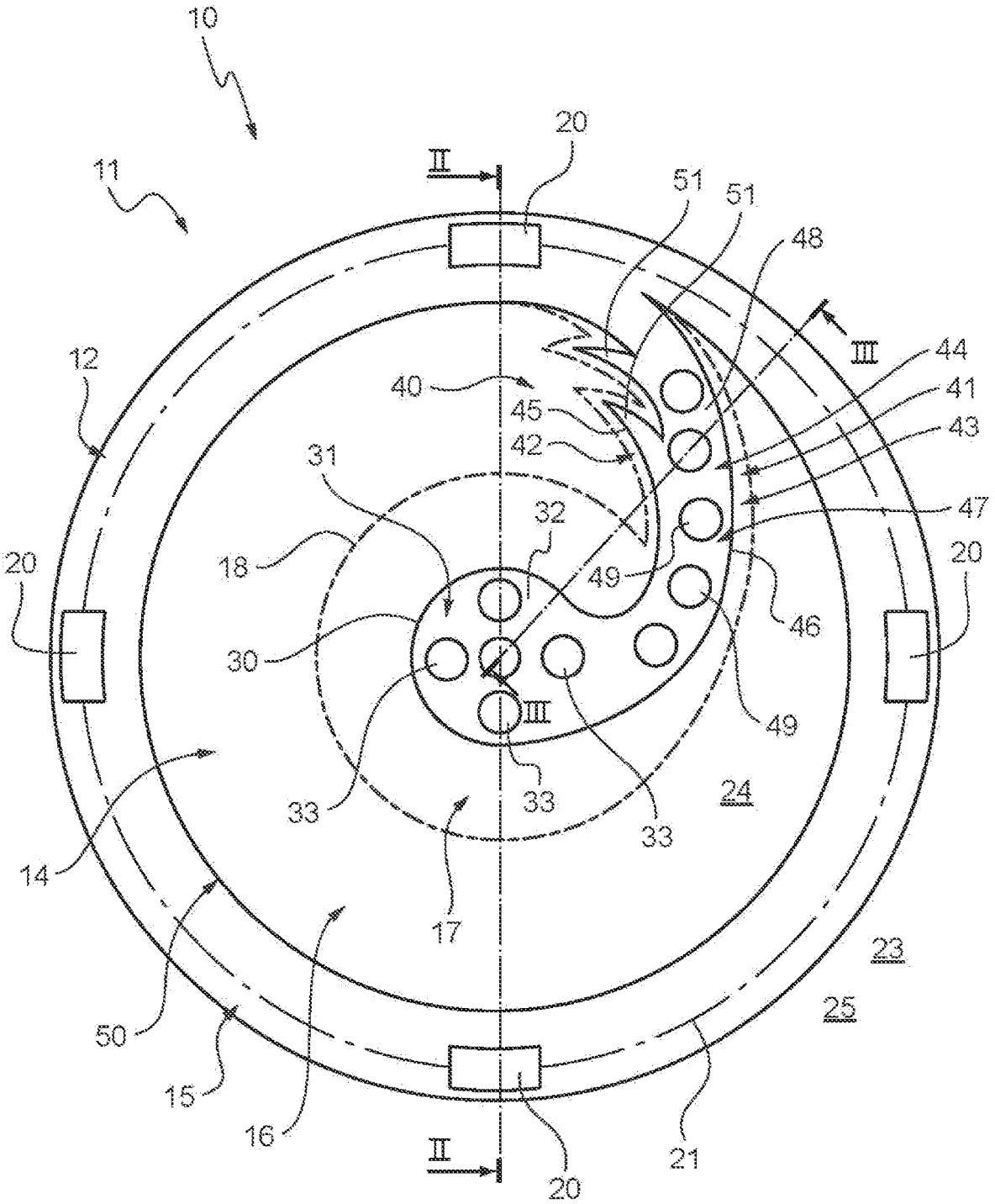
Fig. 1 PRIOR ART
FIGS. 1 to 6 illustrate an facility of the state of the art, already described, from which the facility according to the invention differs solely by the arrangement of the movable members of the wave generator.
Figure 2:
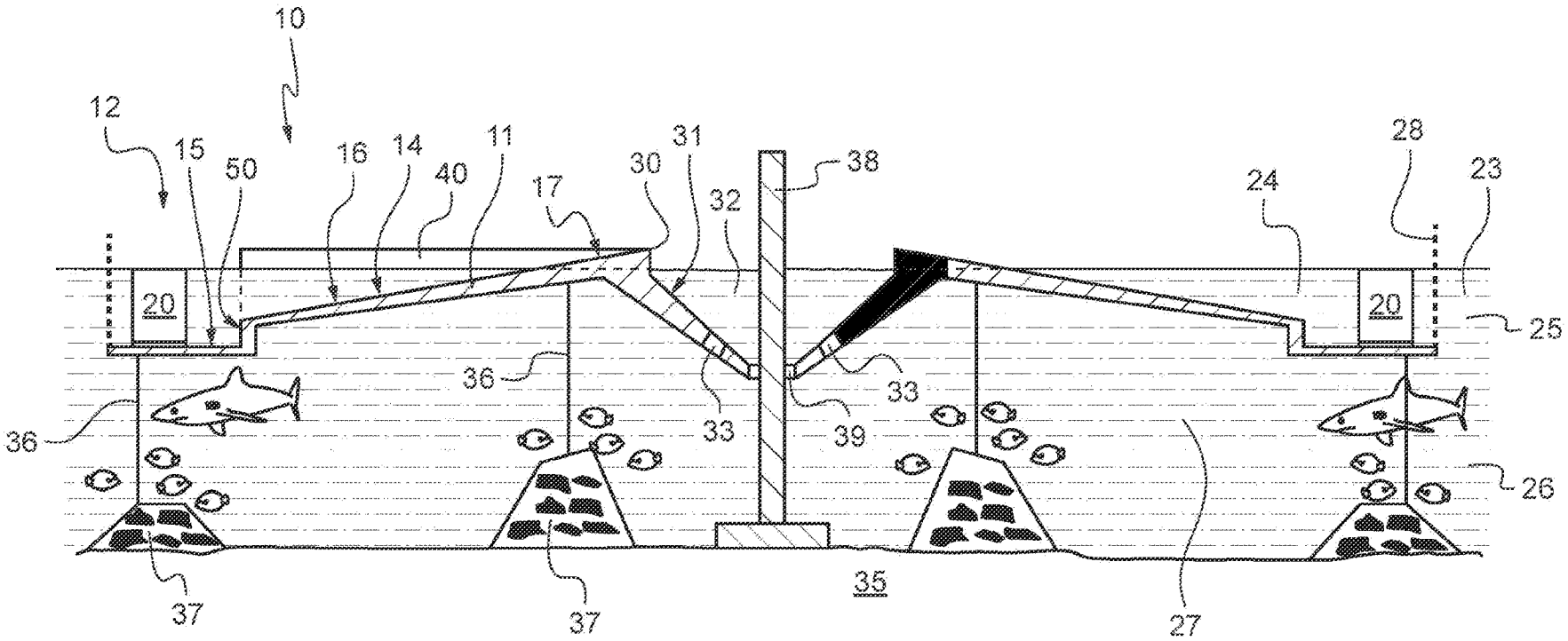
Fig. 2 PRIOR ART
Figure 3:
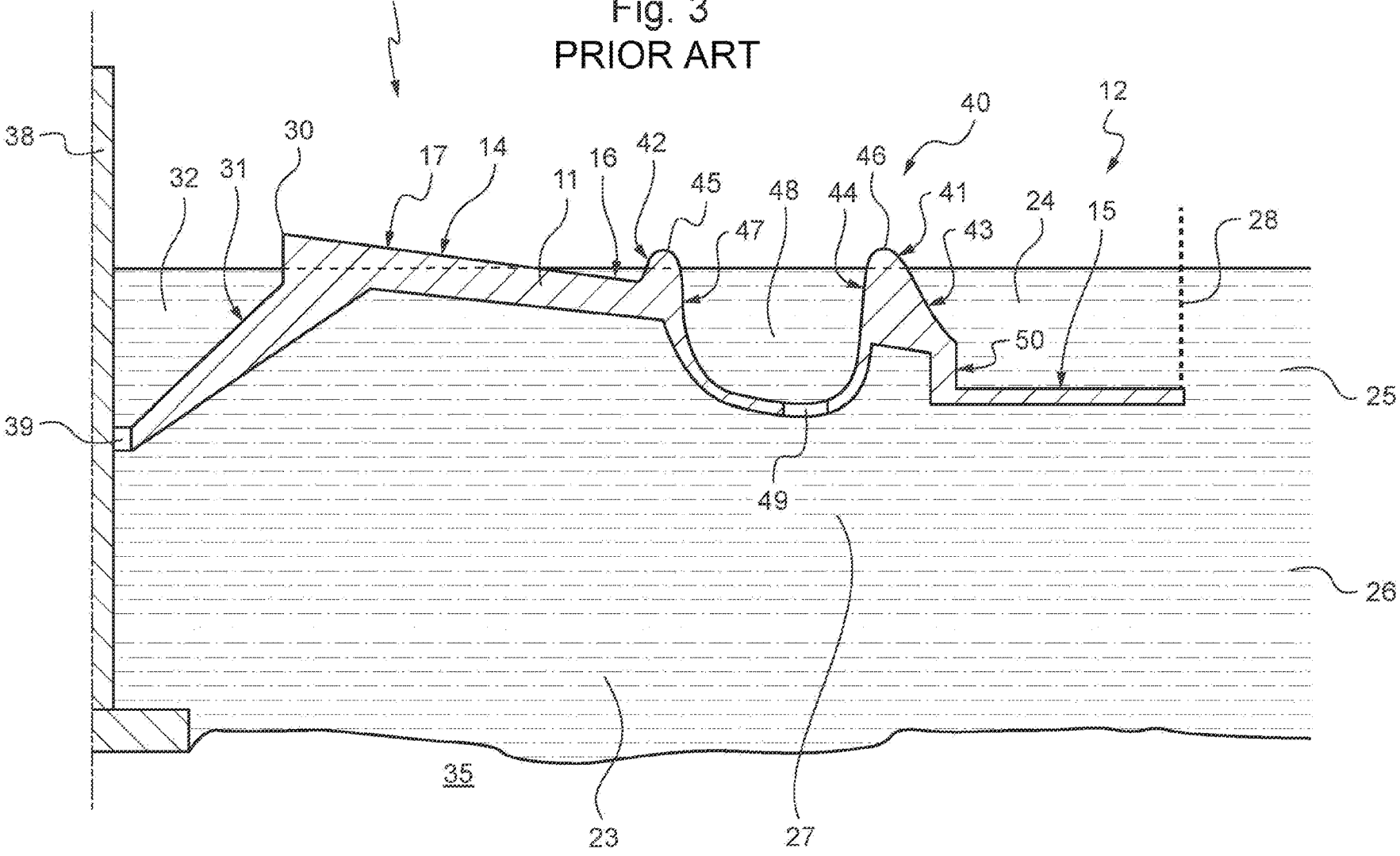
Fig. 3 PRIOR ART
Figure 4:
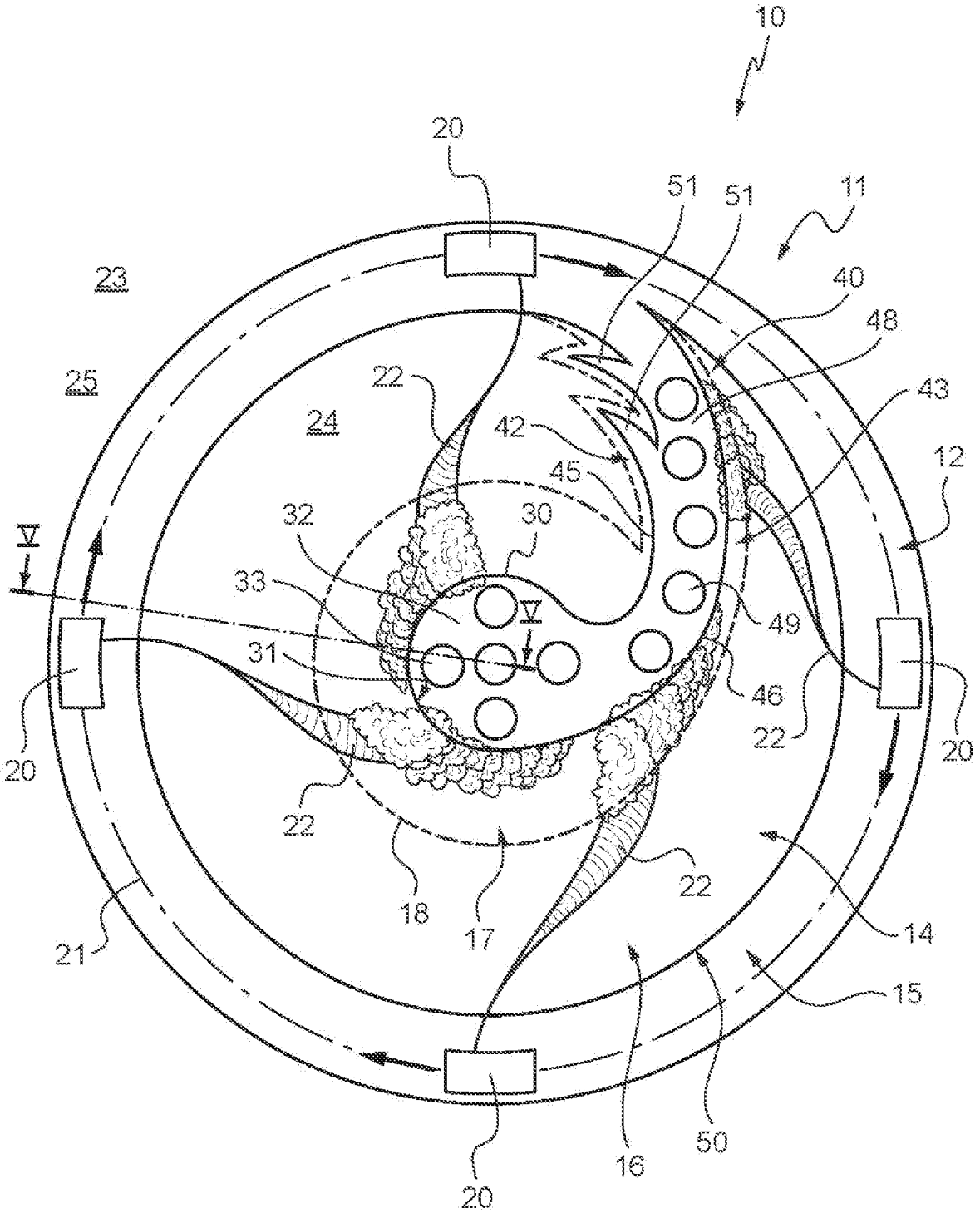
Fig. 4 PRIOR ART
Figure 5:
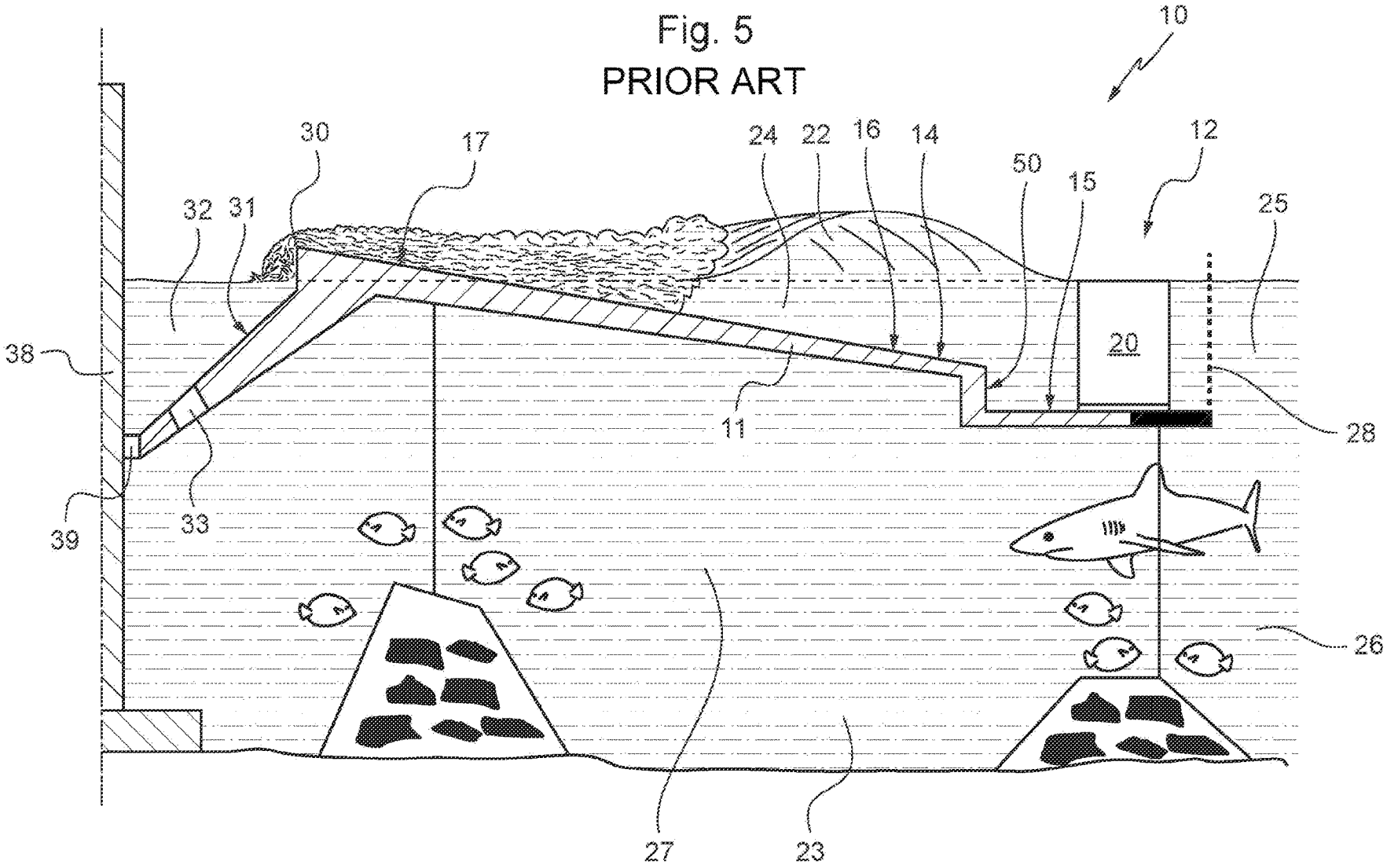
Fig. 5 PRIOR ART

As indicated above, the facility 10' (FIG. 7) according to the invention is identical to the facility 10 illustrated in FIGS. 1 to 6, apart from the fact that the movable members 20 of the wave generator 12 are replaced by movable members 20' arranged differently.

For convenience, with the exception of numerical references 10' and 20', for similar parts, the same numerical references have been kept as for the facility 10 illustrated in FIGS. 1 to 6.

The movable member 20' of the wave generator 12 comprises two bodies shaped with a cross-section of a lift-generating wing, respectively a body 60 and a body 61.

The body 60 is oriented upright, vertically here, and the body 61 has a lying-down orientation, here horizontal.

The bodies 60 and 61 are mechanically connected to each other.

The body 60 has a leading edge 62 facing forward, a trailing edge 63 facing rearward, a first main face 64 extending on a first side between the leading edge 62 and the trailing edge 63, a second main face 65 extending on a second side, which is an opposite side to the first side, between the leading edge 62 and the trailing edge 63, a first lateral face 67 extending from one to the other of the main faces 64 and 65, and a second lateral face 68 extending from one to the other of the main faces 64 and 65.

The first main face 64 faces towards the wave progression zone 16. The second main face 65 faces away from the wave progression zone 16. The first lateral face 66 faces upwards The second lateral face 67 faces downwards.

Here, the first main face 64 of the body 60 is an extrados face, the second main face 65 of the body 60 is an intrados face, the extrados face 64 having a developed length greater than the developed length of the intrados face 65.

Here, the body 60 is shaped with a cross-section of a lift-generating wing according to the NACA 9630 airfoil.

Here, the cord plane passing through the leading edge 62 and by the trailing edge 63 of the body 60 makes an angle, relative to the path 21, and more specifically relative to the local direction of the path 21 (the tangent to that path at the place where the movable member 20' is located), of 13°.

Broadly speaking, an angle comprised between 2° and 20° is particularly suitable for producing the effects sought on the water in which the movable member 20' moves.

The body 61 projects partly from the face 64 of the body 60.

The body 61 has a leading edge 68 facing forward, a trailing edge 69 facing rearward, an extrados face 70 extending on a first side between the leading edge 68 and the trailing edge 69, an intrados face 71 extending on a second side, which is an opposite side to the first side, between the leading edge 68 and the trailing edge 69, the extrados face 70 having a developed length greater than the developed length of the intrados face 71, a first lateral face 72 extending from one to the other of the main faces 70 and 71, and a second lateral face 73 extending from one to the other of the main faces 70 and 71.

The face 70 faces downwards. The face 71 faces upwards. The face 72 faces towards the wave progression zone 16. The face 73 faces away from the wave progression zone 16.

Here, the body 60 extends above and below the body 61.

More specifically, the body 60 extends for approximately two-thirds of its length above the body 61 and the body 60 extends for approximately one third of its length below the body 61.

Here, the leading edge 68 of the body 61 is forward of the leading edge 62 of the body 60; the trailing edge 69 of the body 61 is rearward of the leading edge 62 of the body 60 and forward of the trailing edge 63 of the body 60.

Here, the body 61 is shaped with a cross-section of a lift-generating wing according to the NACA 9630 airfoil.

Here, the chord plane passing through the leading edge 68 and through the trailing edge 69 of the body 61 makes an angle of 13° relative to the horizontal;

Broadly speaking, an angle comprised between 2° and 20° is particularly suitable for producing the effects sought on the water in which the movable member 20' moves.

Figure 11:
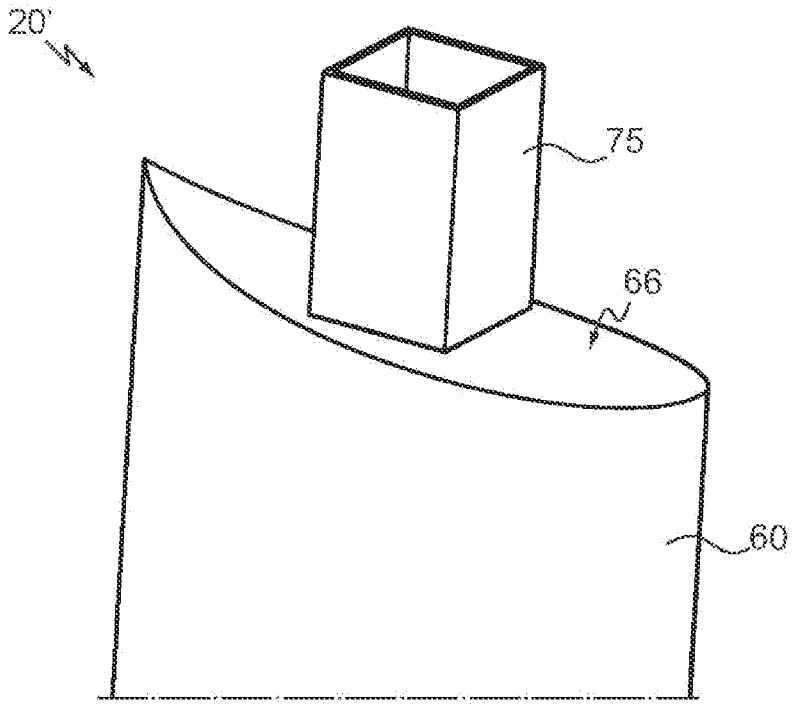
FIG. 11 is a perspective view of the apex of the movable member, showing a mounting lug which the movable member comprises.
Figure 12:
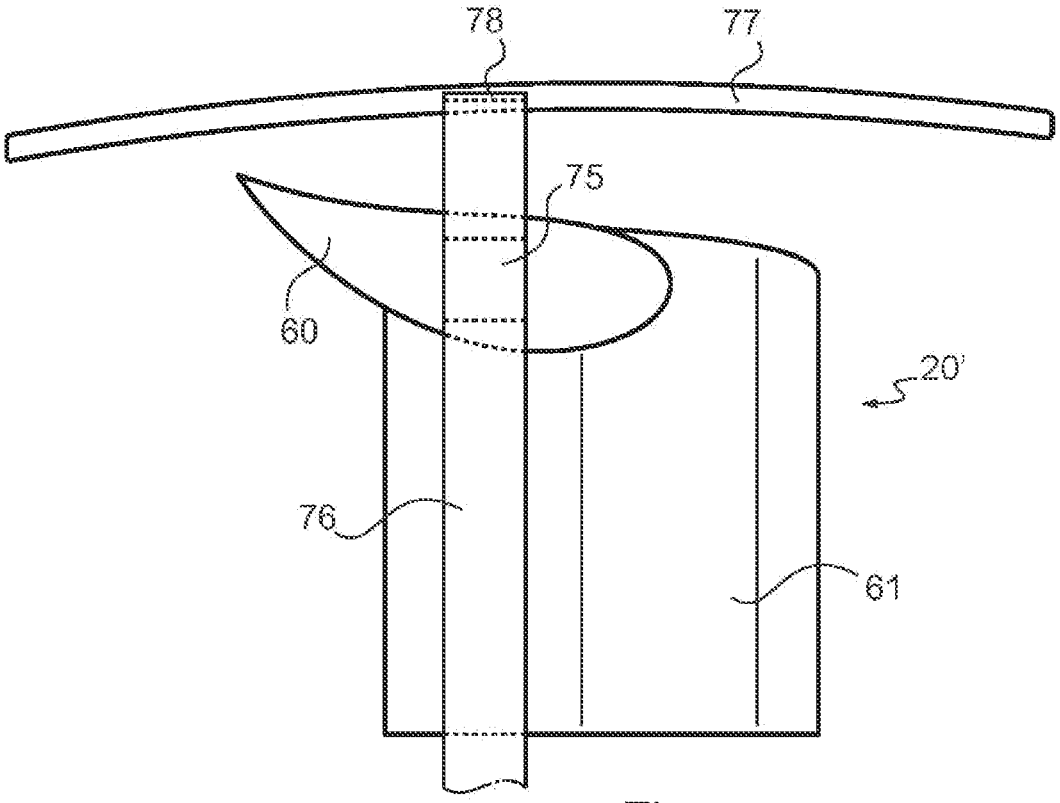
FIG. 12 is a view from above of a variant of the movable member which further comprises a vane-wall.

For its mounting on the rest of the wave generator 12, the movable member 12' has at its apex a mounting lug 75, shown only in FIGS. 11 and 12.

The lug 75 projects from the lateral face 66.

Here, the lug 75 is formed by the continuation of a core beam comprised by the movable member 20'.

To drive the movable member 20', the wave generator 12 comprises a member, here an arm 76 (FIG. 12) which is fastened to the movable member 20' by the lug 75 located at the apex of the body 60.

FIG. 12 shows a variant of the movable member 20' which further comprises a vane-wall 77 mechanically connected to the first body 60 and second body 61.

Here, the vane-wall 77 is oriented upright and disposed laterally along and at a distance from the first and second bodies 60 and 61 on the side to which faces the face 65 of the body 60.

The mechanical connection between the vane-wall 77 and the rest of the movable member 20' is made by a continuation of the arm 76 which engages on a mounting lug 78 located at the apex of the vane-wall 77.

The vane-wall 77 makes it possible to give an effect of additional deflection of the water situated rearward of the movable member 20' and/or a stabilization effect which may be particularly useful if the movable member 20' moves at low speed; and/or a protective effect against external disturbance, for example natural waves present in the aquatic environment where the facility is located.

Figure 6:
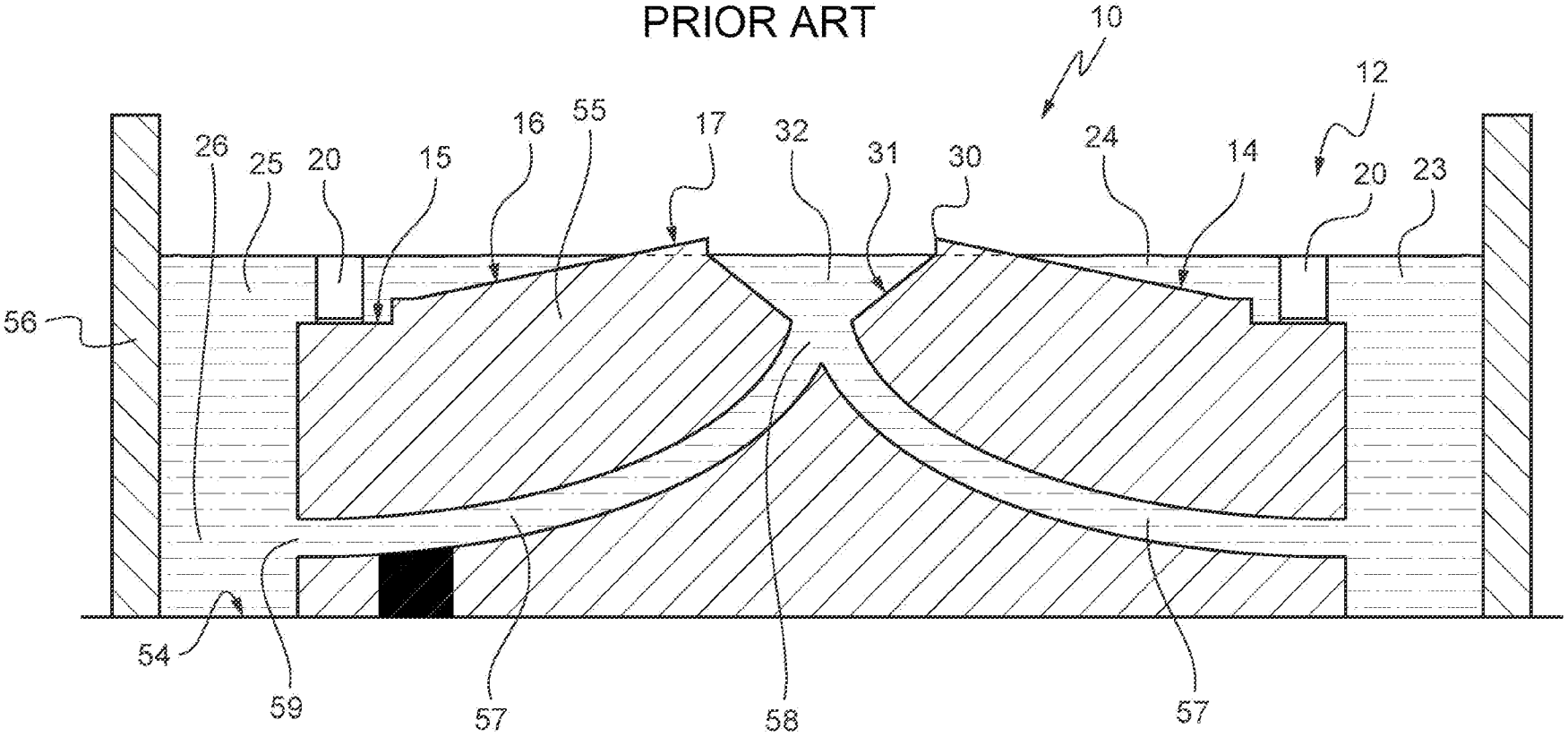
Fig. 6 PRIOR ART
Figure 7:
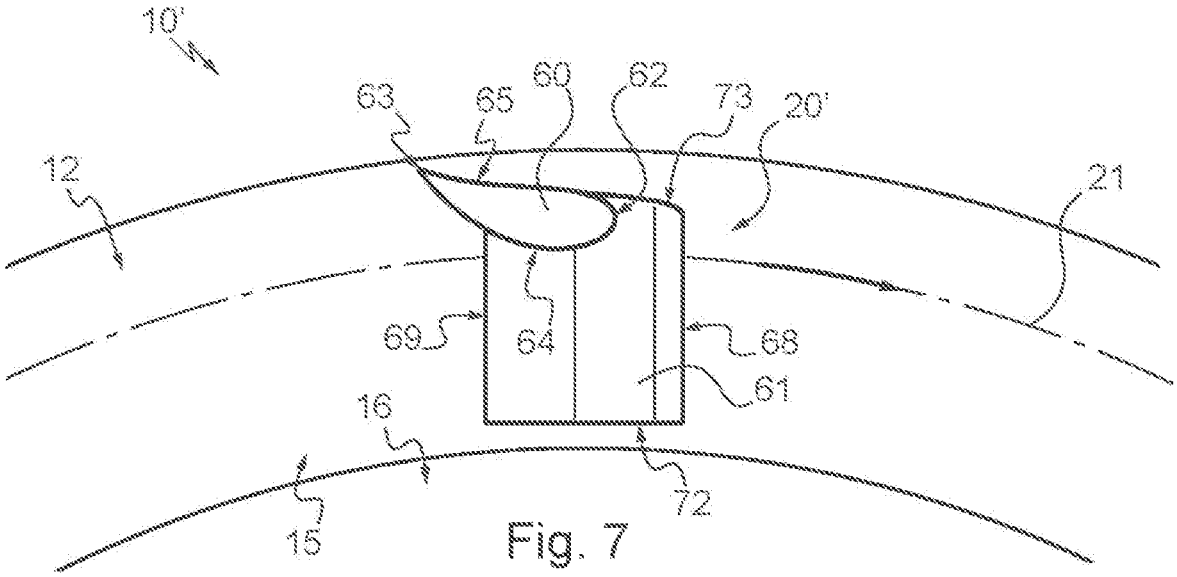
FIG. 7 is a view similar to the upper part of FIG. 4 but for the facility according to the invention, FIG. 7 thus showing in a view from above one of the movable members of the wave generator of the facility according to the invention and the immediate surroundings of that movable member.
Figure 8:
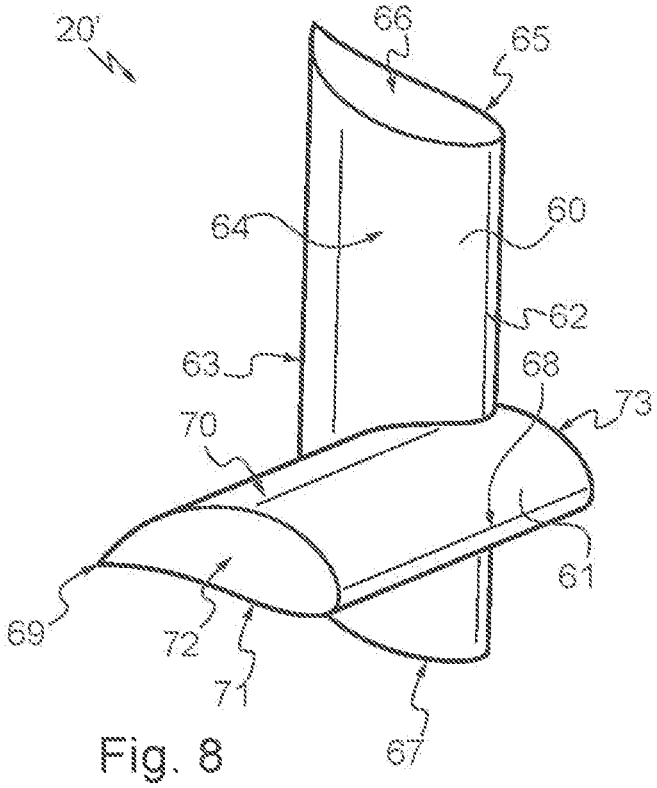
FIGS. 8, 9 and 10 are views of that movable member, respectively in perspective, in front view and in side view.
Figure 9:
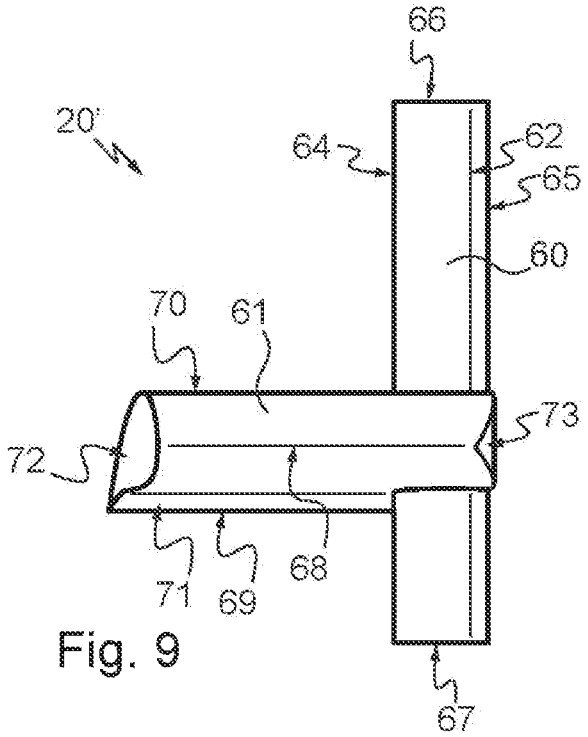
Figure 10:
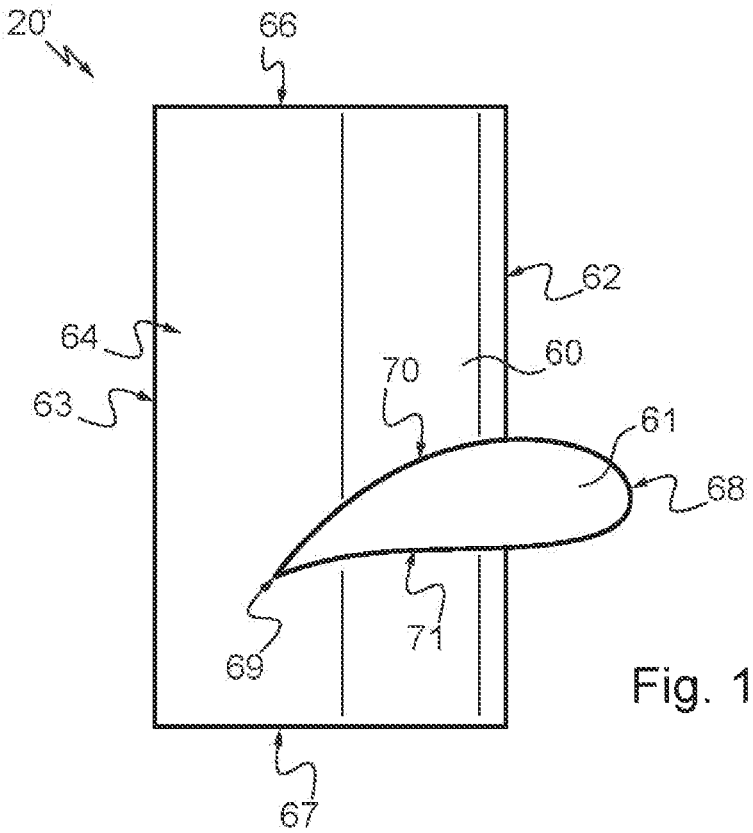

When the facility 10' is implemented as shown in FIG. 6, the fixed lateral wall of the pond 56, which is oriented upright and which the face 65 of the body 60 faces, may also provide such an effect of additional deflection and/or of stabilization.

It will be noted that the edge zone 15 also has the capability of participating in the shape that the water takes rearward of the movable member 20'; and that in a variant not illustrated of the movable member 20', the vane-wall also comprises a portion located below the body 61, or possibly solely below the body 61.

In variants not shown:

the body 60 is oriented upright differently from the vertical orientation, for example with a small tilt or greater tilt relative to the vertical, while being closer to the vertical than to the horizontal.

the body 61 has a lying-down orientation, different from the horizontal orientation, for example with a small tilt or greater tilt relative to the horizontal, while being closer to the horizontal than to the vertical.

the mutual arrangement of the bodies 60 and 61 is different in the front-to-back direction and/or the top-to-bottom direction, for example with the body 60 having a part forward of the body 61 and/or the body 60 being positioned entirely above the body 61;

the shape with a cross-section of a lift-generating wing of the body 60 is different from a NACA 9630 asymmetrical airfoil, for example is a symmetrical airfoil, that is to say that the faces 64 and 65 are mirror images of each other;

The shape with a cross-section of a lift-generating wing of the body 61 is different from a NACA 9630 asymmetrical airfoil, for example another NACA asymmetrical airfoil or an asymmetrical airfoil other than NACA; and/or driving arm 75 is replaced by a drive member different from an arm, for example a wheel rim, and/or the vane-wall 77 is mechanically connected to the rest of the movable member 20' differently than by the continuation of an arm, for example by a spacer linked to a wheel rim.

Numerous other variants are possible according to circumstances, and in this connection it is to be noted that the invention is not limited to the examples described and shown.

The invention claimed is:

1. Artificial wave facility for the practice of surfing, comprising:

a support (11; 55) having an upper surface (14) comprising an edge zone (15), a wave progression zone (16) and a culminating zone (17), the wave progression zone (16) extending, in an upwards slope, from the edge zone (15) to the culminating zone (17);

water situated over said edge zone (15) and said wave progression zone (16);

an artificial wave generator (12), comprising at least one water driving member movable over the edge zone (15) along a predetermined path (21), said wave generator (12) and said upper surface (14) of the support (11; 55) being configured such that when the wave generator (12) is in use, the movable member is laterally followed by a wave (22) moving in the water towards the wave progression zone (16) in contact with which the generated wave (22) breaks towards the culminating zone (17);

wherein said movable member (20') of the wave generator (12) comprises:

a first body (60) shaped with a cross-section of a lift-generating wing, oriented upright, having a leading edge (62) facing forward, a trailing edge (63) facing rearward, a first main face (64) extending on a first side between the leading edge (62) and the trailing edge (63), and a second main face (65) extending on a second side, which is an opposite side to the first side, between the leading edge (62) and the trailing edge (63), the first main face (64) facing towards the wave progression zone (16), said first body (60) being configured in relation to said predetermined path (21) such that when the wave generator (12) is in use, a lift force directed towards the wave progression zone (16) acts on the first body (60); and a second body (61) shaped with a cross-section of a lift-generating wing, having a lying-down orientation, mechanically connected to the first body (60), projecting at least partly from the first main face (64) of the first body (60), having a leading edge (68) facing forward, a trailing edge (69) facing rearward, a first main face (70) extending on a first side between the leading edge (68) and the trailing edge (69), and a second main face (71) extending on a second side, which is an opposite side to the first side, between the leading edge (68) and the trailing edge (69), the second main face (71) facing downward, said second body (61) being configured in relation to said predetermined path (21) such that when the wave generator (12) is in use, an upwardly directed lift force acts on the second body (61).

2. The facility according to claim 1, wherein the first main face (70) of the second body (61) is an extrados face, the second main face (71) of the second body (61) is an intrados face, the extrados face (70) having a developed length greater than the developed length of the intrados face (71).

3. The facility according to claim 2, wherein said first body (60) extends above and below said second body (61).

4. The facility according to claim 2, wherein the leading edge (68) of said second body (61) is forward of the leading edge (62) of said first body (60).

5. The facility according to claim 2, wherein the trailing edge (69) of said second body (61) is rearward of the leading edge (62) of said first body (60) and forward of the trailing edge (63) of said first body (60).

6. The facility according to claim 2, wherein said second body (61) is shaped with a cross-section of a lift-generating wing according to the NACA 9630 airfoil.

7. The facility according to claim 1, wherein said first body (60) extends above and below said second body (61).

8. The facility according to claim 7, wherein the leading edge (68) of said second body (61) is forward of the leading edge (62) of said first body (60).

9. The facility according to claim 7, wherein the trailing edge (69) of said second body (61) is rearward of the leading edge (62) of said first body (60) and forward of the trailing edge (63) of said first body (60).

10. The facility according to claim 1, wherein the leading edge (68) of said second body (61) is forward of the leading edge (62) of said first body (60).

11. The facility according to claim 10, wherein the trailing edge (69) of said second body (61) is rearward of the leading edge (62) of said first body (60) and forward of the trailing edge (63) of said first body (60).

12. The facility according to claim 1, wherein the trailing edge (69) of said second body (61) is rearward of the leading edge (62) of said first body (60) and forward of the trailing edge (63) of said first body (60).

13. The facility according to claim 1, wherein said second body (61) is shaped with a cross-section of a lift-generating wing according to the NACA 9630 airfoil.

14. The facility according to claim 1, wherein a chord plane passing through the leading edge (68) and through the trailing edge (69) of the second body (61) makes an angle comprised between 6° and 20° relative to the horizontal.

15. The facility according to claim 1, wherein said movable member (20') further comprises a vane-wall (77) mechanically connected to said first body (60) and second body (61), said vane-wall (77) being oriented upright and disposed laterally along and at a distance from the first body (60) and second body (61) on the side to which faces the second main face (65) of the first body (60).

16. The facility according to claim 1, further comprising a fixed lateral wall (56), oriented upright, which the second main face (65) of the first body faces.

17. The facility according to claim 1, wherein said artificial wave generator (12) further comprises a drive member (76) for driving said movable member (20'), said drive member (76) being fastened to said movable member (20') by the apex of said first body (60).

18. The facility according to claim 1, wherein the first main face (64) of the first body (60) is an extrados face, the second main face (65) of the first body (60) is an intrados face, the extrados face (64) having a developed length greater than the developed length of the intrados face (65).

19. The facility according to claim 18, wherein said first body (60) is shaped with a cross-section of a lift-generating wing according to the NACA 9630 airfoil.

20. The facility according to claim 1, wherein a chord plane passing through the leading edge (62) and through the trailing edge (63) of the first body (60) makes an angle comprised between 2° and 20° relative to said predetermined path (21).

* * * * *